United States Patent [19]

Swenson

[11] 4,033,735

[45] July 5, 1977

[54] SINGLE MIXED REFRIGERANT, CLOSED LOOP PROCESS FOR LIQUEFYING NATURAL GAS

[75] Inventor: Leonard K. Swenson, Kansas City, Mo.

[73] Assignee: J. F. Pritchard and Company, Kansas City, Mo.

[22] Filed: Nov. 8, 1976

[21] Appl. No.: 739,793

Related U.S. Application Data

[63] Continuation of Ser. No. 612,183, Sept. 10, 1975, abandoned, which is a continuation of Ser. No. 106,524, Jan. 14, 1971, abandoned.

[52] U.S. Cl. ..... 62/9; 62/40

[51] Int. Cl.² ..... F25J 1/00

[58] Field of Search ..... 62/9, 40

[56] References Cited

UNITED STATES PATENTS 3,364,685 1/1968 Perret ..... 62/40

FOREIGN PATENTS OR APPLICATIONS 895,094 5/1962 United Kingdom ..... 62/40

*Primary Examiner*—Hiram H. Bernstein

*Attorney, Agent, or Firm*—Schmidt, Johnson, Hovey & Williams

[57] ABSTRACT

A fluid material is cooled through a temperature range exceeding 200° F. by heat exchange with a single mixed refrigerant composition in a heat exchange zone forming a part of a closed loop refrigeration cycle thus assuring high reliability and low investment by virtue of simplification of the equipment required and ease of control thereof. The process is especially useful for liquefaction of natural gas. Refrigerant in the refrigeration loop containing constituents having increasingly lower boiling points is successively directed from a compression zone to a condensation zone, thence to a heat exchange zone, next expanded in an expansion zone, returned to the heat exchange zone for countercurrent flow against the refrigerant flowing therethrough from the condensation zone to the expansion zone, and finally returned to the compression zone. The natural gas is directed to the heat exchange zone and liquefied therein by countercurrent flow against the cold refrigerant stream flowing from the expansion zone to the compression zone. The refrigerant is made up of $C_1$ to $C_5$ hydrocarbons plus nitrogen as an optional constituent with the relative proportions of the constituents being controlled so that the combined cooling curve of the hot refrigerant stream and the feed gas closely matches the heating curve of the cold refrigerant stream in a sense that the curves are in close proximity at the lowest temperature levels thereof and relatively uniformly and slowly diverge as the highest temperature points on the curves are approached.

11 Claims, 4 Drawing Figures

Figure 1A:
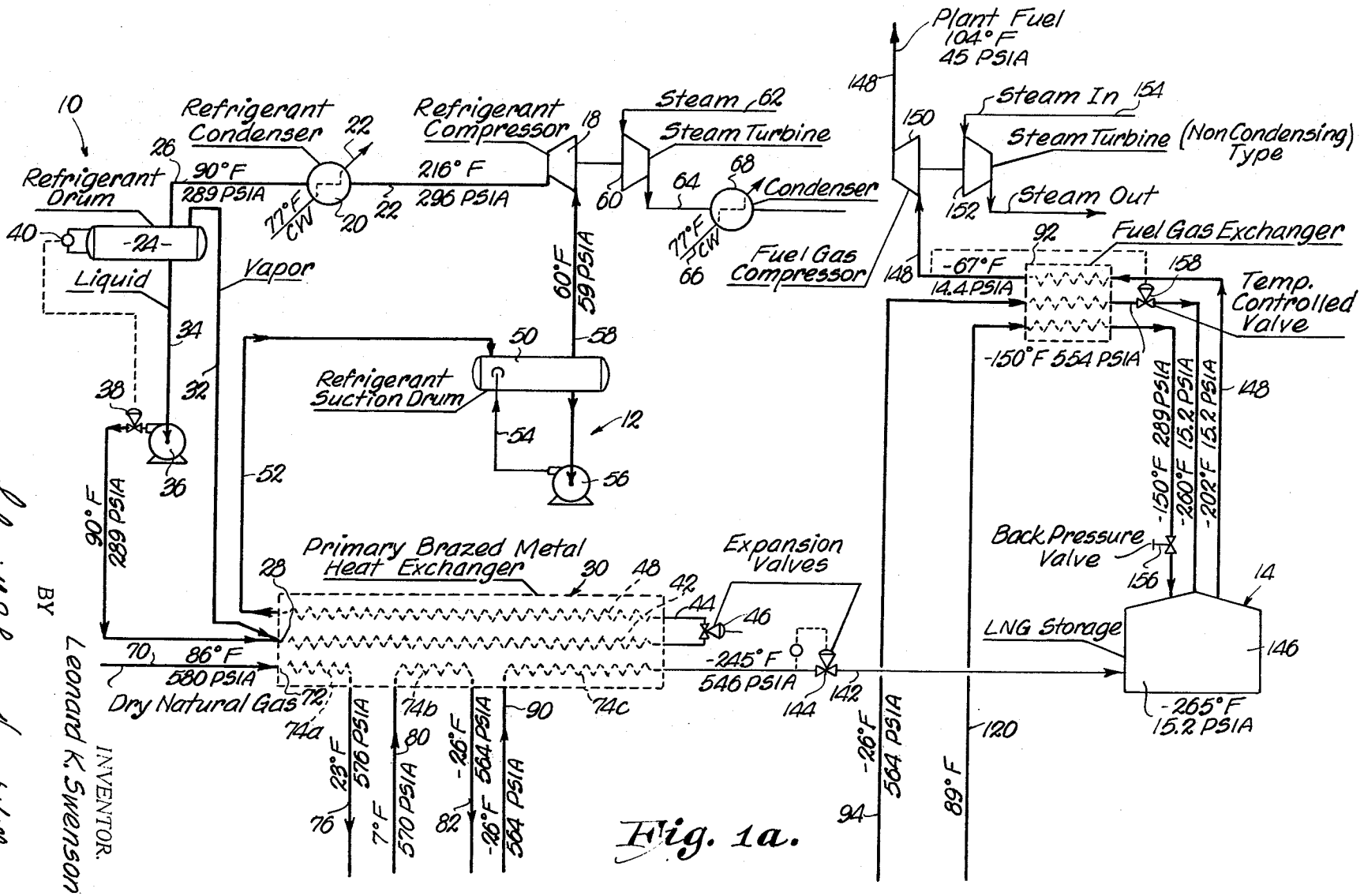

INVENTOR.
Leonard K. Swenson

BY

Schmidt, Johnson, Hovey & Williams
ATTORNEYS.

INVENTOR.
Leonard K. Swenson
BY
Schmidt, Johnson, Hovey & Williams
ATTORNEYS

INVENTOR.
Leonard K. Swenson
BY
Schmidt, Johnson, Hovey & Williams
ATTORNEYS.

SINGLE MIXED REFRIGERANT, CLOSED LOOP PROCESS FOR LIQUEFYING NATURAL GAS

This is a continuation of application Ser. No. 612,183 abandoned filed 9-10-75 (which was in turn a continuation of Ser. No. 106,524 filed 1-14-71 now abandoned.

This invention relates to a process for lowering the temperature of a fluid through a wide temperature range utilizing a single mixed refrigerant, closed loop refrigeration system wherein the material to be cooled is brought into thermal interchange relationship with the refrigerant composition and lowered in temperature from an initial level to a low temperature in a single pass through the heat exchange zone of the system. The mixed refrigeration cycle not only permits utilization of a mininum of equipment but also simplifies control thereof.

Many process schemes have heretofore been proposed and sone used commercially to lower the temperature of a fluid to a low level, as for example 200° F to more than 300° F below its initial temperature, wherein a plurality of separate refrigeration units are employed in what is usually termed a cascade system for cooling the material from the initial temperature value to a desired low temperature level as the product to be cooled is successively passed through a series of heat exchangers having a refrigerant medium circulated therethrough of increasingly lower temperature. Cascade refrigeration systems are advantageous because they have minimum horsepower requirements in that the refrigerant operating at the highest temperature range may be condensed against an available cooling medium such as water while the other refrigerants in the sequence are condensed against higher boiling point refrigerant streams.

Although cascade systems are efficient from the standpoint of power input required for cooling effect obtained, there is necessarily a relatively large investment in the equipment required to put the system into commercial practice and the controls for such equipment are expensive and require close monitoring to assure continuous satisfactory operation of the plant.

As the demand for natural gas has rapidly increased in recent years, efforts to provide an improved method of liquefying natural gas for storage and transportation has increased because of the difficulty and cost of attempting to transport large volumes of natural gas in gaseous condition from the source thereof to an ultimate point of use. For example, the demand for natural gas is generally highest at geographical points far removed from sites of production of the gas. As a consequence, it has been found advantageous to liquefy the gas either at the point of origin and then transport it in liquefied condition to a point of use, or liquefy the natural gas product at areas of use during periods of low demand for vaporization and introduction into the gas supply lines as needed during times of high demand. In either case though, liquefaction of the natural gas requires lowering of the temperature thereof through a range generally exceeding 300° F. in order that the natural gas may be stored in liquid condition at essentially ambient pressure with normal boil-off of the gas being used to maintain the same in liquid form. Most natural gas liquefaction plants have been constructed to operate on the cascade refrigeration principle notwithstanding the high capital costs involved in such facilities.

It is therefore an important object of the present invention to provide a process for lowering the temperature of a fluid material through a wide temperature range, as for example sufficient to effect liquefaction of natural gas, by passing the natural gas or other fluid material in thermal interchange relationship with a single mixed refrigerant in a heat exchange zone thus permitting utilization of a minimum of equipment and controls and wherein the refrigerant composition is made up of constituents having a wide range of boiling points so that by passing the hot refrigerant stream from the condenser of the refrigeration loop, against the cold refrigerant stream output from the expansion valve of the loop, in the same heat exchange zone through which the natural gas to be liquefied is directed, the composition of the refrigerant can be adjusted as necessary to bring the combined cooling curve of the hot refrigerant and feed gas into relatively close matching relationship to the heating curve of the cold refrigerant stream to not only minimize the horsepower requirements of the compression stage of the refrigeration loop, but also the physical size of the single heat exchanger as well.

Another important object of the invention is to provide a process for cooling a fluid medium through a temperature range exceeding 200° F. wherein the mixed refrigerant is made up of a mixture of hydrocarbons and optionally a quantity of nitrogen as well thus minimizing the cost of the refrigerant, assuring ready availability of the constituents of the refrigerant composition, and permitting makeup to be obtained from the natural gas stream itself for the most part if natural gas is to be cooled to its liquefaction temperature in the single heat exchange zone of the refrigeration loop.

A still further important object of the invention is to provide a process for cooling a fluid medium such as natural gas through a temperature range to effect liquefaction thereof wherein the efficiency of the product cooling may be maximized by determining the heating curve of the cold refrigerant passed through the heat exchange zone of the refrigeration loop and then comparing this curve with a combined curve of the product feed and hot refrigerant stream through the heat exchange zone so that most efficient cooling of the product may be obtained by closely matching the hating and cooling curves in the sense that the curves are brought into close proximity at the lowest temperature levels thereof and then caused to slowly and relatively uniformly diverge as the highest temperature points are approached. A corollary object of the invention is to provide a process as described wherein the combined cooling curve of the product feed and hot refrigerant stream through the heat exchange zone in one instance and the heating curve of the cold refrigerant stream in the other instance may be brought into essentially matched, slowly diverging relationship by the simple expedient of increasing or decreasing the quantity of respective refrigerant constituents on a selective basis as may be required to widen the spacing when the curves are too close, or narrow the gap therebetween as necessary. Still another object of the invention is to provide a single mixed refrigerant process for liquefying natural gas or cooling a product stream to a low level temperature wherein the constituents of the mixed refrigerant have successively lower boiling points so that by adding or removing portions of constituents which effect the cooling and heating curves referred to above, at those points therealong, where the curves are either too close or too widely spaced, the desired, closely spaced, slow and uniform divergence thereof as the upper ends of the curves are approached may be readily obtained and maintained.

A further important object of the invention is to provide a process for cooling a fluid material through a wide temperature range wherein the mixed refrigerant composition is characterized by the properties being resistant to freezing at the final low temperature level reached, at least one of the constituents having a boiling point lower than that to which the material is to be cooled, at least one other constituent having a boiling point sufficiently high to permit condensation thereof against a cooling medium at least 200° F. higher than the temperature level to which the material is to be cooled and the refrigerant being capable of undergoing complete liquefaction and then vaporization when passed against itself in a single heat exchange zone after pressure let down between the hot and cold refrigerant streams whereby the material to be cooled can be lowered in temperature through the entire wide range thereof by simply directing such material through the heat exchange zone concurrent with the hot refrigerant stream and countercurrent to the cold refrigerant stream.

A still further important object of the invention is to provide a single mixed refrigerant process as described for liquefying natural gas or cooling a fluid material to a low level wherein freezing of high boiling point constituents in the natural gas or liquid material within the confines of the heat exchange zone may be readily avoided by diverting the natural gas from the heat exchange zone at a point where liquefaction of the high boiling constituents has occurred followed by treating of such diverted material to remove the constituents therefrom which would freeze at the final temperature to which the natural gas or other product is lowered within the heat exchange zone with the treated stream then being returned to the heat exchanger for continuation of the flow thereof in thermal interchange relationship with the mixed refrigerant.

A still further important object of the invention is to provide a single mixed refrigerant, closed loop process for liquefying natural gas or cooling a fluid material through a temperature range exceeding 200° F. wherein a brazed metal heat exchanger is preferably used in the heat exchange zone for most efficient thermal interchange between the product undergoing cooling and the mixed refrigerant composition by virtue of the fact that the heat exchanger may be located in essentially horizontal disposition so that there is equal distribution of liquids and vapors throughout the width of the exchanger with all surfaces thereof being in continuous use during operation of the equipment. In this connection, a further important object is to provide an improved single mixed refrigerant process wherein leakage of wet gas or liquids into the refrigerant is eliminated by virtue of the fact that there is no opportunity for the product to be cooled to come into contact with the refrigerant composition in the exchanger.

Figure 1B:
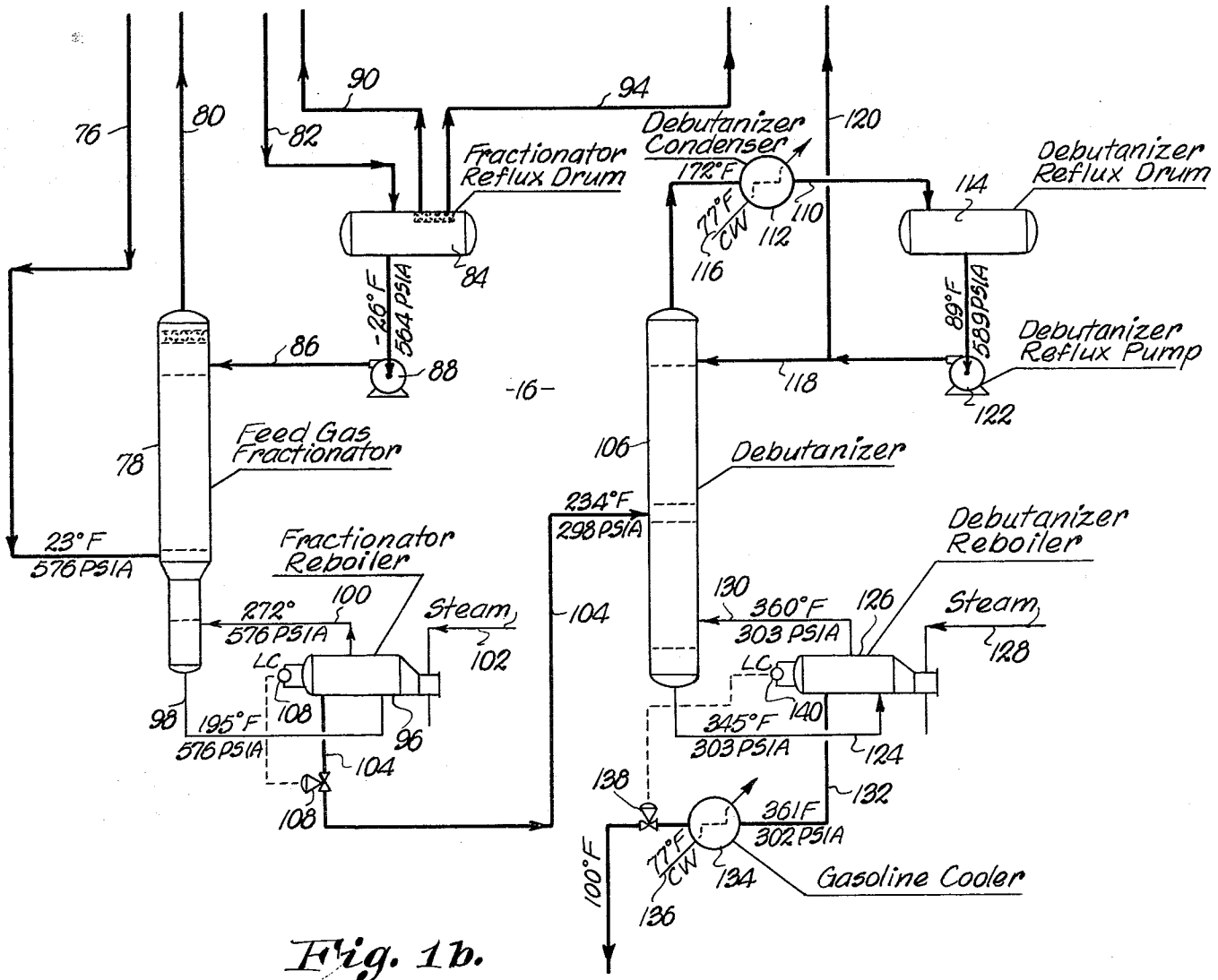
Figure 2:
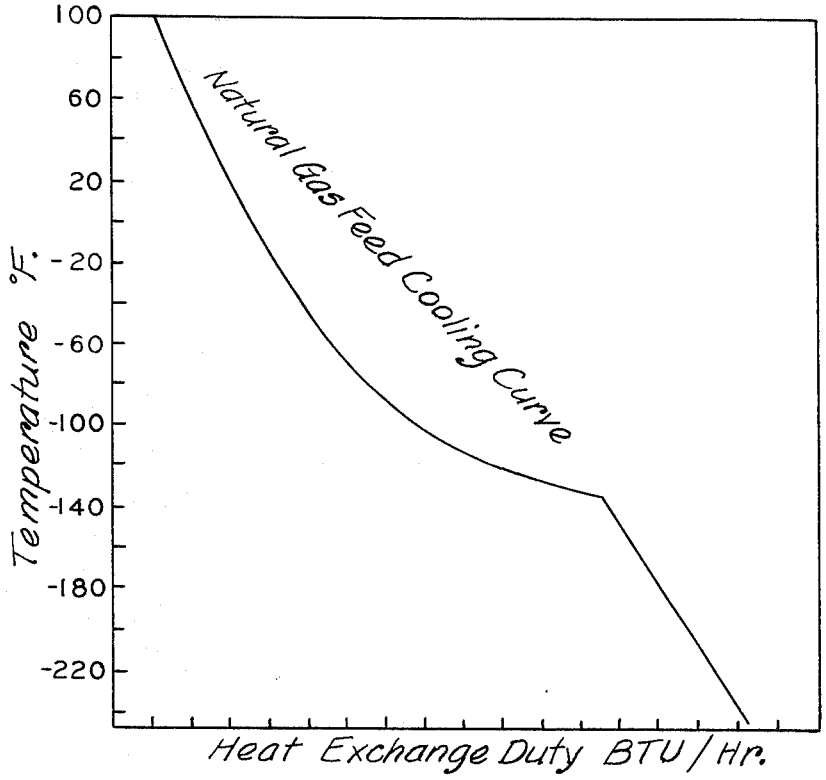
Figure 3:
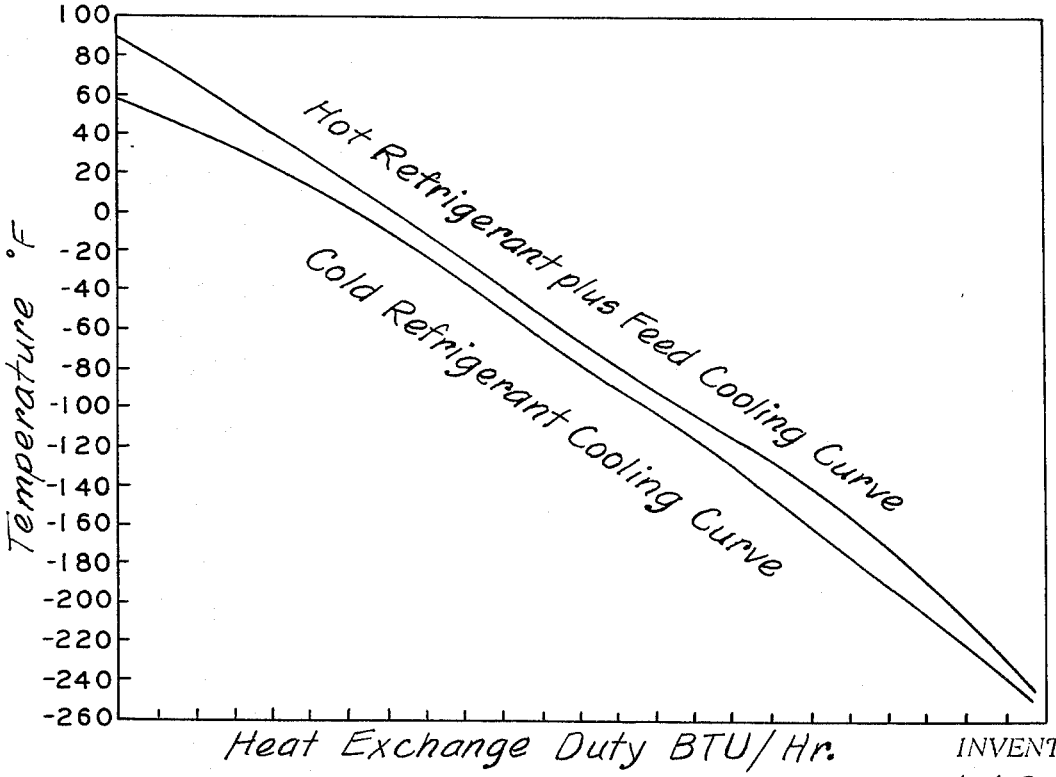

In the drawings:

FIGS. 1*a* and 1*b* in combination illustrate in schematic form equipment especially useful for carrying out the process of the present invention wherein a single mixed refrigerant is provided in a closed loop system for cooling a fluid material such as natural gas to liquefy the latter and wherein auxiliary apparatus is associated with the refrigerant system for removing heavy ends which could freeze in the heat exchanger, or where it is desirable to control the Btu content of the gas;

FIG. 2 is a graphical representation of the cooling curve for a natural gas product typical of that which may be liquefied in the apparatus of FIGS. 1*a* and 1*b*; and FIG. 3 is a graphical representation of the heating curve of the cold mixed refrigerant flowing from right to left in the primary brazed metal heat exchanger of the refrigeration system shown in FIG. 1*a* as compared with the cooling curve of the hot refrigerant and feed streams flowing from left to right in the brazed metal heat exchanger of FIG. 1*a*, when the composition of the refrigerant has been controlled to provide a close match between the curves.

In order to better illustrate the novel process of this invention, equipment for carrying out the method in an efficient manner is illustrated schematically in FIGS. 1*a* and 1*b* under the broad numeral designation 10. The principal components of equipment 10 make up a closed loop, mixed refrigerant refrigeration system 12, a storage unit 14 for the cooled product, and a fractionation unit 16 for removing heavy ends from the natural gas feed stream before such products can freeze in the heat exchanger of refrigeration system 12.

Although equipment 10 is adapted for cooling various types of fluid materials through a temperature range in excess of 300° F., for simplicity and to increase the clarity of the description of this process and its operation, it will be assumed for the purposes thereof that equipment 10 is adapted for liquefying a dry natural gas input containing primarily methane but also substantially smaller amounts of nitrogen and $C_2$ to $C_8$ hydrocarbons. The exact composition of a typical natural gas product requiring liquefaction is detailed hereinafter in the description of a normal operating cycle of equipment 10.

First describing refrigeration system 12 containing a single mixed refrigerant, it can be seen in FIG. 1*a* that the output from refrigerant compressor 18 is directed to condenser 20 via line 22 to bring the compressor outflow into thermal interchange relationship with cooling water passing through condenser water supply and return line 23. Out of condenser 20, the mixed refrigerant composition is introduced into horizontal refrigerant drum 24 via line 26. A number of different types of heat exchangers may be used in carrying out the improved process of this invention, but best results are obtained with minimum horsepower input to the plant, when a brazed metal (for example aluminum) heat exchanger is used in refrigeration system 12.

Although the preferred process involves the use of a single heat exchanger 30 for economy of equipment and plant operation expense, it is to be recognized that where volume or space limitations from the standpoint of physical equipment available for a particular job, the heat exchange zone of the refrigeration loop may in the alternative be made up of either a single heat exchanger, a number of heat exchangers in series, or one or a plurality of heat exchangers in parallel relationship with the important factor being the utilization of a single mixed refrigerant system. Vapor line 32 serves to communicate the top part of drum 24 with mixed vapor and liquid inlet orifices 28 of heat exchanger 30. Liquid line 34 extending from the bottom portion of refrigerant drum 24 and leading to inlet 28 of heat exchanger 30 has a pump 36 interposed therein as well as a control valve 38 downstream of pump 36 and operated by a level controller 40 operably associated with refrigerant drum 24.

The hot refrigerant made up of the combination of vapor and liquid supplied to exchanger 30 through inlet passages 28 flows through the exchanger 30 from left to right as indicated in FIG. 1*a* along a path designated 42, which in turn communicates directly with U-shaped line 44 having an expansion valve 46 therein. The cold refrigerant emanating from expansion valve 46 flows back through heat exchanger 30 in countercurrent relationship to the flow path 42 along a right-to-left path designated 48 in the drawings. The outflow from path 48 through heat exchanger 30, is conveyed to refrigerant suction drum 50 via line 52. Any liquid collected in the suction drum 50 is recirculated back thereto through the provision of line 54 having a pump 56 interposed therein. In the event the quantity of liquid commences to build up in drum 50, the excess may be drained from line 54 through an outlet not shown. A liquid controller for drum 50 may be provided if desired for preventing excessive buildup of liquid in the interior of the refrigerant suction drum. The vapor overhead from refrigerant drum 50 is directed to compressor 18 via line 58. It is to be understood in this respect that compressor 18 may be either of the axial flow or centrifugal type.

Compressor 18 is driven by any suitable prime mover which for example may comprise a conventional steam turbine 60 operably coupled to the shaft of compressor 18 and driven by steam from supply line 62 connected to the turbine, while the return line therefor leads back to the steam generator after the steam has been subjected to cooling water from supply and return line 66 joined to steam condenser 68.

The dry natural gas to be liquefied is supplied through line 70 connected to the inlet passages 72 of heat exchanger 30 for flow along a discontinuous path therethrough in cocurrent flow relationship to the hot refrigerant directed along path 42 and countercurrent to refrigerant flow along cold refrigerant path 48.

During initial flow of the natural gas through heat exchanger 30 along path 74*a*, the natural gas is cooled to an extent to effect liquefaction of at least certain of the heavy constituents in the gas at the pressure of the product supplied, whereupon the natural gas stream is then diverted from exchanger 30 via line 76 and introduced into upright feed gas fractionator 78 intermediate the ends of the latter. The gaseous overhead from fractionator 78 is returned via line 80 to heat exchanger 30 for flow along path 74*b* which is again cocurrent with the hot refrigerant stream and countercurrent to the cold refrigerant flow. In order to provide reflux liquid for feed gas fractionator 78, the natural gas stream is again diverted from exchanger 30 via line 82 which is operably coupled to fractionator reflux drum 84. Liquid from drum 84 is introduced into the top part of fractionator 78 through line 86 provided with a liquid pump 88 therein. Gaseous overhead from fractionator reflux drum flows away therefrom either through main product line 90 leading back to path 74*c* through heat exchanger 30, or alternatively via supply line 94 to the fuel gas exchanger 92 forming a part of storage unit 14.

The liquid bottoms from factionator 78 are directed to fractionator reboiler 96 through line 98 with the gaseous overhead from reboiler 96 being returned to fractionator 78 via line 100. Steam is supplied to the reboiler through steam supply line 102. Liquid is removed from reboiler 96 through line 104 connected to the central part of upright debutanizer vessel 106. Valve 108 in line 104 adjacent reboiler 96 controls the level of liquid therein by virtue of the provision of a level control device 109 operably associated with reboiler vessel 96.

The debutanizer section of fractionation unit 16 is an optional system to permit return of $C_4$ and below hydrocarbons to the natural gas stream and assuring that only $C_5$ and above hydrocarbons are separated from the natural gas supply. To this end, the gaseous overhead from vessel 106 is discharged therefrom through line 110 having a water cooled condenser 112 therein and leading to debutanizer reflux drum 114. Cooling water supply and return line 116 joins to condenser 112. The condensate from condenser 112 is collected in drum 14 and returned either to the top part of debutanizer 106 via line 118, or to fuel gas exchanger 92 through line 120. Pump 122 in line 118 assures positive return of the reflux to vessel 106 or fuel gas exchanger 92.

The liquid bottom from debutanizer 106 are directed via line 124 into debutanizer reboiler 126 which in turn receives steam via steam supply line 128. The overhead from reboiler 126 is returned to debutanizer vessel 106 through line 130 while the liquid underflow from reboiler 126 leads to a point of use via line 132 having a water cooled condenser 134 therein connected to cooling water supply and return line 136. Valve 138 in line 136 downstream of condenser 134 controls the level of liquid in debutanizer reboiler 126 under the influence of liquid control device 140.

The liquefaction path 74*c* of heat exchanger 30 is joined to a liquefied product line 142 having a pressure letdown valve 144 therein and leads to a liquefied natural gas storage tank 146.

Boil-off from tank 146 is preferably used for plant fuel and therefore is directed to plant fuel use via line 148 which passes through fuel gas exchanger 92 as well as fuel gas compressor 150 downstream of exchanger 92. Stream turbine 152 operably joined to fuel gas compressor 150 has a steam and return line 154 coupled thereto for supplying steam to drive the compressor. Line 120 which also extends through fuel gas exchanger 92 and terminates in communication with storage tank 146 has a back pressure valve 156 therein. Line 94 communicating with the interior of storage tank 146 after passage through fuel gas exchanger 92 is provided with a temperature controlled valve 158 downstream of exchanger 92 and which is under the influence of a sensor located on line 148 downstream of the fuel gas exchanger 92.

As previously indicated, the process hereof is uniquely adapted to lower the temperature of a fluid material such as natural gas through a temperature range exceeding 200° F. by a single passage of the product to be cooled through the heat exchange zone with the refrigerant being condensable against a cooling medium at least 200° F warmer than the final temperature of the natural gas. The process has greatest utility in cooling a pressurized dry natural gas stream from a normal supply line temperature and pressure down to a level where the gas liquefies at the supply pressure notwithstanding the fact that the gas is directed through only a single heat exchanger. This wide range cooling of the natural gas is attributable to the use of a novel single mixed refrigerant composition provided in refrigeration system 12. Thus, in order to illustrate the utility of the present process as carried out in equipment 10, it is believed that this can best be accomplished by reference to a specific natural gas supply stream and the corresponding mixed refrigerant composition for use therewith, although it is to be fully understood that the parameters set forth hereunder are illustrative only and that various fluid materials may be cooled over a wide temperature range in accordance with the present method utilizing equipment as schematically depicted in FIGS. 1*a* and 1*b* and that the mixed refrigerant composition should be matched to the product to be cooled, as will be explained.

However, assuming for purposes of illustration only that dry natural gas which has been previously prepared for liquefaction by purification to remove acid gases, water and other undesirable impurities, is supplied through line 70 at a temperature of about 86° F. and a pressure of 580 p.s.i.a., refrigeration system 12 in cooperation with fractionation unit 16 should be capable of liquefying the natural gas by cooling the stream to a temperature of about −245° F. at 546 p.s.i.a. during a single passage through the heat exchange zone while at the same time effecting removal of those heavy ends in the natural gas which would freeze in the heat exchanger 30. In addition, all but $C_5$ and higher hydrocarbons may be returned to the natural gas for Btu control of the product delivered to storage tank 146.

Accordingly, if the natural gas after drying and purification thereof is supplied to heat exchanger path 74*a* at the temperature and pressure indicated on line 70 of FIG. 1*a*, and the natural gas has the following composition, the liquefaction thereof can be accomplished with the temperature and pressure parameters expressed on the figures of the drawing so long as the mixed refrigerant has a composition approximately as specified hereunder:

| COMPOSITION | TABLE I NATURAL GAS MOLE % (APPROX.) | TABLE II REFRIGERANT MOLE % (APPROX.) |
|---|---|---|
| Helium | 0.2 | trace |
| Nitrogen | 5.8 | 10.6 |
| Methane | 83.2 | 35.6 |
| Ethane | 7.1 | 28.2 |
| Propane | 2.25 | 3.4 |
| Isobutane | 0.4 | 8 |
| Normal butane | 0.6 | 2.1 |
| Isopentane | 0.12 | 11.4 |
| Normal pentane | 0.15 | .7 |
| Hexane | 0.1 | trace |
| $C_7$ hydrocarbons and above | 0.08 | trace |

The mixed refrigerant composition is preferably of a composition such that the constituents thereof can be obtained from the natural gas feed and also to cause the cooling curve of the hot refrigerant stream along path 42 of heat exchanger 30 combined with the cooling curve of the natural gas stream along paths 74*a* – 74*c* to closely match the heating curve of the cold refrigerant along path 48 of heat exchanger 30 as illustrated in FIG. 3 of the drawings. The cooling curve of natural gas having a composition as set forth in Table I above is essentially as illustrated in FIG. 2. The hump in the curve is caused by extra heat which must be removed to liquefy the heavy ends of the natural gas supply stream. In order to smooth or straighten out the curve so that it more closely matches the shape of the heating curve of the refrigerant composition, the constituents and relative quantities of the mixed refrigerant are carefully selected and controlled so that there is a close match between the cold refrigerant heating curve and the hot refrigerant plus feed stream curve as depicted graphically in FIG. 3.

If the quantity of feed gas passed in heat exchange relationship of the cold refrigerant stream flowing along path 48 is maintained as a small fraction of the refrigerant flow then the combined cooling curve of the feed gas plus hot refrigerant tends to assume the same shape as the cooling curve of the hot refrigerant curve for that particular refrigerant. Then, if the refrigerant has constituents the same as or similar to the product stream to be cooled, the cooling curve of the hot refrigerant stream is similar to the cooling curve of the product to be cooled or liquefied. However, in order to smooth out or straighten this curve, the relative quantities of the refrigerant constituents are increased or decreased as necessary to provide relatively straight curves which rather closely match. Since obtaining a cooling effect at the lowest temperature is more costly than at the highest temperature where cooling is commenced, it is desirable that the curves be in close proximity at the lowest temperature to provide a 2° to 6° F. temperature approach, and then gradually and relatively uniformly diverge as the highest plotted temperature levels are reached so that the approach at the upper part of the cooling and heating curves is of the order of 20° to 40° F. In view of the fact that the pressures vary between the hot refrigerant and cold refrigerant stream, it is to be recognized that to bring the cooling curves together or to shift them apart at any particular temperature requires increase or decrease as appropriate of a constituent whose boiling points at the pressures in respective sides of the refrigeration loop will cause the cooling curves to shift relatively at that particular temperature level.

For example, if the product to be cooled is dry natural gas and it is desired to lower the temperature of such gas to a level to effect liquefaction thereof at the pressure supplied, the range of constituents of a refrigerant derived from the natural gas, can be expected to fall within the following ranges:

TABLE III

| REFRIGERANT CONSTITUENT | MOLE FRACTION % |
|---|---|
| $N_2$ | 0 – 12 |
| $C_1$ | 20 – 36 |
| $C_2$ | 20 – 40 |
| $C_3$ | 2 – 12 |
| $C_4$ | 6 – 24 |
| $C_5$ | 2 – 14 |

In the above table, $C_1$ represents primarily methane. $C_2$ represents either ethylene or ethane, and $C_3$ represents propylene or propane. $C_4$ is intended to include both isobutane as well as normal butane and unsaturated hydrocarbon equivalents thereof. Similarly, $C_5$ represents isopentane and normal pentane along with olefinic equivalents of the same. It is to be understood though that the hydrocarbons chosen must not freeze in admixture at the lowest temperature to which the refrigerant is cooled in the refrigeration cycle. In its preferred form, a mixed refrigerant for use in liquefying natural gas in a single heat exchanger should contain on a mole fraction percent basis, 0% to 15% of nitrogen, 20% to 40% of methane, 20% to 36% of ethane, 2% to 12% of propane, 5% to 16% of isobutane, 1% to 8% of normal butane, 1 ½% to 16% of isopentane and ½% to 4% of normal pentane. Manifestly, the exact refrigerant composition will necessarily be different depending upon the nature of the product to be cooled with an effort being made to obtain a relatively close match between the cooling and heating curves as depicted in FIG. 3. Optimum results are obtained when the curves are closest at the lowest temperature level and slowly and uniformly diverge as the higher temperature plotted are approached. In all events, severe pinches or very close spacing of the curves is to be avoided if possible.

Thus, if a natural gas product of the composition set forth in Table I above is to be cooled, it is to be noted from Table II that a preferred mixed refrigerant composition should contain on a mole fraction basis, about 10.6% nitrogen, 35.6% of methane, 28.2% of ethane, 3.4% of propane, 8% of isobutane, 2.1% of n-butane, 11.4% of isopentane, and 0.7% of n-pentane. In addition, the flow rate of the natural gas or other fluid product to be cooled should be regulated so that the delivery of the gaseous material to the heat exchanger 30 is about 60% to 110% on a mole fraction basis of the moles of condensed refrigerant delivered to passages 28 of heat exchanger 30 defining the entrance to path 42 therethrough. The horsepower requirements of the process go up significantly when this range is exceeded on the low side by virtue of the increased vapor which must be compressed and recirculated. On the high side, a lower temperature level cooling medium for the condenser must be available than is the case with conventional cooling water and this cooling source either is not normally present at all, or can be obtained only at significant extra cost.

Typical operating parameters for plant 10 when it is set up to liquefy dry natural gas of the composition indicated in Table I hereof utilizing a refrigerant composition as set down in Table II, are set out on respective lines in the schematic showing of FIGS. 1*a* and 1*b* wherein it can be seen that in the exemplary process depicted, the natural gas is supplied to the plant at a temperature of 86° F. and 580 p.s.i.a. thus making it necessary to lower the temperature of the product to about −245° F. in heat exchanger 30 in order to assure full liquefaction of the gas at the outlet pressure thereof from exchanger 30 which is of the order of 545 p.s.i.a. In this connection, it is to be understood that the refrigeration system 12 and particularly heat exchanger 30 are sized so as to assure complete liquefaction of the refrigerant passing along path 42 of exchanger 30, coupled with complete vaporization of the refrigerant flowing along path 48 from valve 46 to drum 50. In the exemplary process described herein, the suface area of path 48 should be about 65%, the surface area of path 42 about 35% and the combined surface area of paths 74*a* – 74*c* about 5% of the total thermal interchange surface area of exchanger 30. In addition, the refrigerant composition should contain constituents which do not freeze when the entire refrigerant is lowered to the liquefaction temperature thereof, and at least certain of the constituents should partially vaporize when lowered in pressure by virtue of expansion across valve 46 or when the refrigerant is introduced into the interior of exchanger 30 for flow along path 48. Finally, full vaporization of the refrigerant composition along flow path 48 is preferred so that the suction of compressor 18 is at or near its dew point at all times during continuous operation of equipment 10.

In view of the fact that it is impractical to reject sufficient heat from refrigeration system 12 through sensible transfer only, it is essential that at least a certain proportion of the heat rejection be in the form of latent heat transfer effected by condensation of at least a portion of the mixed refrigerant in refrigerant condenser 20. However, in order to permit practical operation of the process under normally encountered conditions, the mixed refrigerant composition must contain constituents which are condensable at the output pressure from refrigerant compressor 18 at a temperature more than 200° F. above the liquefaction temperature of the product and preferably using a readily available, inexpensive condensing medium such as cooling water (in the exemplary process described herein, 77° F. cooling water is shown as being typical of a coolant medium which can be expected to be available in most instances, although it is to be understood that the temperature of such cooling water will necessarily vary from site to site and that the operating parameters of the process must be adjusted accordingly, including variation of the composition of the mixed refrigerant if necessary). Generally speaking, the proportion of the mixed refrigerant condensable to liquid form in condenser 20 should comprise about one-fifth to one-fourth of the refrigerant vapor directed to condenser 20 from compresssor 18. In the specific process depicted in FIGS. 1*a* and 1*b*, utilizing a refrigerant composition as set forth in Table II for cooling a natural gas product as indicated in Table I, under the operating parameters outlined in the schematic drawing, about 20% of the refrigerant composition is condensed to liquid form while 80% thereof remains in a vapor condition.

Assuming for purposes of illustration that equipment 10 shown in FIGS. 1*a* and 1*b* is in continuous operation after all start-up procedures have been completed, the mixed refrigerant flowing through the closed loop path defined by system 12, includes liquid at 90° F. and 289 p.s.i.a. and vapor at the same temperature and pressure which are introduced into passages 28 of heat exchanger 30 from lines 34 and 32 respectively for flow along path 42. The temperature of the hot refrigerant stream directed along path 42 is continuously lowered as the hot refrigerant passes in heat exchange relationship with cold refrigerant flowing along path 48. As previously noted, exchanger 30 is sized so that the refrigerant flowing along path 42 undergoes complete liquefaction and thereby exits from exchanger 30 at a temperature of about −245° F. The only pressure drop therein is a function of loss attributable to flow through the exchanger passages. The pressure of the refrigerant is lowered across valve 46 and the orifices of the exchanger defining the passages presenting path 48 therethrough to an extent that the outlet pressure of the refrigerant exiting from exchanger 30 is about 59 p.s.i.a. whereby the temperature of the refrigerant composition commencing flow along path 48 is about −249° F. (effecting vaporization of about 3% of the refrigerant) whereas the temperature of the refrigerant discharged from path 48 is about 60° F. (in completely vaporized condition for delivery to drum 50 via line 52).

The vaporized refrigerant is directed to compressor 18 where the pressure thereof is increased to 296 p.s.i.a. thus raising its temperature to 216° F. The 77° F. cooling water passed through condenser 20 via line 22 lowers the temperature of the refrigerant exiting from the condenser to 90° F. thus condensing about 20% of the total refrigerant composition as previously noted.

The dry natural gas conveyed to heat exchanger 30 for introduction into the passages thereof defining path 74*a* is brought into thermal interchange relationship with the refrigerant streams defined by path 42 and 48 to gradually lower the temperature of the gas. By virtue of the fact that the flow rate of the to refrigerant flow with respect to the natural gas is within the range of 60% to 110% refrigerant on a mole basis with respect to the moles of gaseous material directed to inlet passages 72 of heat exchanger 30, principal thermal interchange takes place between the hot refrigerant flowing along path 42 and the cold refrigerant directed along path 48 in countercurrent relationship thereto, thus assuring very little if any temperature differential between the natural gas and the refrigerant streams in thermal interchange relationship thereto. The refrigeration cycle is thus virtually insensitive to removal of heat from the natural gas stream and making possible relatively close matching of the heating curve of the cold refrigerant with the combined cooling curve of the cold refrigerant and the feed gas.

The fractionation system 16 shown in FIG. 1*b* is an optional part of the equipment 10 and if desired, the natural gas can simply be conveyed along a continuous path 74 of sufficient length to assure liquefaction of the gas at its supply pressure so that the product may be directed to storage, either after expansion to substantially ambient pressure, or at a high pressure level if suitable storage apparatus is provided for maintaining the gas in pressurized condition.

Assuming though that it is desirable to remove heavy hydrocarbons from the natural gas supply stream, either because sufficient freezable heavies are present in the feed stream to present a freezing problem in the heat exchanger 30, or for Btu control, or both the natural gas may be diverted from path 74*a* via line 76 at any desired point along the length of the brazed metal heat exchanger. For example, in the illustrative process depicted, the natural gas is diverted from heat exchanger 30 at 23° F. where at least the heaviest components of the natural gas are in liquefied condition at the supply pressure of the gas, so that upon introduction of such mixture of gas and liquid into fractionator vessel 78 via line 76, separation of gaseous constituents from the liquid fraction thereof is effected. The gaseous overhead from the fractionator is then directed back to exchanger 30 via line 80 for flow along path 74*b*. In order to provide most efficient separation of gas from liquid constituents in the product stream introduced into fractionator vessel 78, the natural gas is again diverted from heat exchanger 30 via line 82 so that additional liquid formed in the natural gas stream upon the lowering of the temperature thereof to −26° F. may be separated from the gaseous phase in reflux drum 84 and then introduced into the top part of fractionator 78 via line 86 leading from drum 84.

The liquid bottoms from fractionator 78 are directed to reboiler 96 which serves to return most of the $C_4$ and lower hydrocarbon constituents back to fractionator 78 which were delivered from the bottom of vessel 78 along with the $C_5$ and higher hydrocarbons.

Since a small proportion of butanes and lower hydrocarbons are still contained in the outflow from line 104 of reboiler 96, a debutanizer section as shown in FIG. 1*b* may be provided to further reduce the loss of $C_4$ and lower hydrocarbons from the natural gas stream directed to storage tank 146, and assure that the outflow from equipment 10 via line 132 is restricted to $C_5$ and higher hydrocarbons. Accordingly, by operating fractionator 78 and its associated reboiler 96 under conditions such that the inflow to debutanizer vessel 106 through line 104 is at a temperature of 234° F. and a pressure of 298 p.s.i.a. separation of $C_4$ and lower hydrocarbons from heavier hydrocarbons can be effectively carried out by subjecting the gaseous overhead from debutanizer vessel 106 to 77° F. coling water in condenser 112 so that reflux returned to vessel 106 via line 118 at a temperature of 89° F. causes the overhead from the debutanizer to be at about 172° F. at the inlet to condenser 112. Similarly, operation of reboiler 126 under conditions such that vapors returned to vessel 106 via line 130 are at a temperature level of 360° F. and 303 p.s.i.a., conditions are established in vessel 106 such that the liquid underflow therefrom is at a temperature of about 345° F. at the operating pressure of 303 p.s.i.a. The liquid bottoms from reboiler 126 delivered therefrom through line 132 can be expected to comprise in excess of 90% $C_5$ hydrocarbons and above.

The fuel gas supply portion of equipment 10 is also of optional nature and has been shown as illustrative of a typical arrangement for using the boil-off from storage tank 146 required to maintain the liquefied product in liquid condition, as a source of fuel for operating the plant, which for example often includes a vaporization unit. Thus, in the process shown wherein it is desired that the natural gas be stored at essentially ambient pressure by expanding the output from heat exchanger 30 to ambient pressure acros expansion valve 144 thereby lowering the temperature of the product to −265° F. for storage at 15.2 p.s.i.a., the boil-off needed to maintain the required −265° F. temperature can readily be used as a fuel supply for the plant requirements, not only for steam, but at least a part of the vaporization equipment as well, if this apparatus is included as a part of the overall facility. In order to warm the boil-off up to a temperature level where it can be introduced into fuel gas compressor 150 without the necessity of providing expensive metal components for such compressor capable of withstanding extremely low temperature levels, certain of the product streams from fractionator system 16 are brought into heat exchange relationship to the natural gas boil-off flowing through line 148 to raise the temperature of the gas from a level of −202° F. at the outlet from tank 146, to at least about −67° F. before entering compressor 150.

To this end, gaseous overhead from fractionator reflux drum 84 is conveyed via line 94 to fuel gas exchanger 92 while liquid from reflux drum 114 may also be passed through fuel gas exchanger 92 by virtue of the provision of a bypass line 120 extending from line 118 to a flow passage through exchanger 92 and thence an appropriate inlet to storage tank 146. In each instance, valves such as the back pressure valve 156 in line 120 and valve 158 in line 94 assures that liquid product at essentially ambient temperature is returned to storage tank 146.

Although a minor amount of flashing does take place across valve 158, the major proportion of the product stream in line 120 downstream of valve 158 is in liquid form.

One particularly important feature of the improved process of this invention utilizing equipment 10 having a fractionator section 16 is the fact that makeup of refrigerant hydrocarbons to refrigeration system 12 may be accomplished by withdrawal of liquid from various tray locations above the feed tray in the heavy ends fractionator 78. For example, a pentane-rich composition is available near the feed tray. An ethane-rich composition is available near the top of the fractionator. Intermediate components are also available from intermediate trays. Methane makeup as neded may be obtained from the overhead output from fractionator 78, while nitrogen may be obtained from the nitrogen rich boil-off gas going overhead from tank 146.

Having thus described the invention, what is claimed as new and desired to be secured by Letters Patent is:

1. A process for cooling a fluid feed material from an initial temperature to a level from over 200° Farenheit to over 300° Farenheit therebelow and consisting essentially of the steps of:

providing a single mixed refrigerant composition capable of said material and containing a number of refrigerant constituents having a wide range of successively lower boiling points;

passing said refrigerant composition through a single closed loop refrigeration cycle consisting essentially of compression, partial condensation, multiple path heat exchange and expansion zones;

maintaining the flowing constituents of the refrigerant composition and the relative proportions thereof indentical throughout said compression, partial condensation, multiple path heat exchange and expansion zones of the single closed loop cycle, the total mixed refrigerant composition being successively directed

1. from the compression zone to the partial condensation zone for partial condensation of the refrigerant by an external cooling medium to produce a vapor phase and a liquid phase,

2. the vapor phase and the liquid phase from the condensation zone are combined,

3. the combined phases are directed to the heat exchange zone for flow without change in composition along a. a first path therethrough, next b. to the expansion zone, and then c. back to the heat exchange zone for flow along a second path therethrough in countercurrent, thermal interchange relationship to refrigerant flow along said first path, and

4. the refrigerant composition is then returned to the compression zone;

directing the fluid feed material through said heat exchange zone along a third path in concurrent flow thermal interchange relationship to the refrigerant flowing along said first path and countercurrent to the refrigerant flow along said second path to effect the required cooling of the fluid feed material in said heat exchange zone by only the refrigerant composition of said single closed loop cycle, at least one of the refrigerant constituents having a boiling point in the second path lower than the temperature level to which the fluid feed material is lowered in said heat exchange zone, the constituents of the refrigerant composition in admixture having freezing points below said temperature level to which the feed material is lowered, and said refrigerant composition being characterized by the properties of 1. at least a portion thereof being vaporizable across said expansion zone, 2. substantially all of the refrigerant becoming liquid along said first path through the heat exchange zone, and 3. substantially all of the composition undergoing vaporization along said second path through the heat exchange zone at the respective temperatures and pressures of the refrigerant existing along said first and second paths; providing a total of at least five refrigerant constituents in said refrigerant composition in

1. relative quantities of

2. respective relative boiling points and

3. circulating the refrigerant composition in said closed loop cycle at a sufficiently higher rate than the flow of feed material along said third path through the heat exchange zone, to a. lower the temperature level of said fluid feed material in the heat exchange zone as it flows therethrough from more than 200° Fahrenheit to over 300° Fahrenheit below its initial temperature as directed to the heat exchange zone, while b. maintaining a minimal temperature difference between the fluid feed material and the refrigerant composition in thermal interchangeable relationship thereto throughout the length of the heat exchange zone, and at the same time to c. cause the combined cooling curve of the fluid feed material flowing along said third path and the refrigerant flowing along said first path and the heating curve of the refrigerant flowing along said second path to both be of relatively straight, closely adjacent, generally matched configuration throughout the respective flow paths of the refrigerant and said feed material through the heat exchange zone; and passing a cooling medium in heat exchange relationship with the refrigerant composition flowing through said partial condensation zone, said cooling medium being at a temperature from more than 200° Fahrenheit to over 300° Fahrenheit above the temperature of the fluid feed material exiting from said heat exchange zone, at least one other of the refrigerant constituents having a boiling point to cause only partial condensation of the refrigerant in said partial condensation zone at the temperature and pressure of the refrigerant composition as it flows through said partial condensation zone from the compression zone to the heat exchange zone.

2. A process as set forth in claim 1, wherein is included the step of introducing constituents into the refrigerant composition to cause the cooling curve of the refrigerant flowing along the second path to be maintained in close proximity to the combined cooling curve of the refrigerant and the material flowing along respective first and third paths with the curves in closest proximity at the lowest temperature thereof and slowly and relatively uniformly diverging as the highest temperaure is approached.

3. A process as set forth in claim 1, wherein the material to be cooled is in gaseous condition at said initial temperature thereof and including the step of regulating the rate of delivery of the material to said heat exchange zone to cause the moles of refrigerant partially condensed to liquid in the condensation zone to be at least about 60% of the moles of said gaseous material directed to said heat exchange zones.

4. A process as set forth in claim 1, wherein the material to be cooled is in gaseous condition at said initial temperature thereof and including the step of regulating the rate of delivery of the material to said heat exchange zone to cause the moles of refrigerant partially condensed to liquid in the condensation zone to be from about 60% to approximately 110% of the moles of gaseous material directed to said heat exchange zone.

5. A process as set forth in claim 4, wherein the proportion of refrigerant vapor condensed to form the liquid phase entering the heat exchange zone is maintained at about one-quarter ot one-fifth of the vapor phase directed to said heat exchange zone.

6. A process as set forth in claim 5, wherein the material to be cooled is natural gas in gaseous condition at said initial temperature and the refrigerant composition is provided with an admixture on a mole fraction basis of 0% to 12% of nitrogen, 20% to 36% of $C_1$ hydrocarbon, 20% to 40% of a $C_2$ hydrocarbon, 2% to 12% of a $C_3$ hydrocarbon, 6% to 24% of a $C_4$ hydrocarbon and 2% to 20% of a $C_5$ hydrocarbon.

7. A process as set forth in claim 6, wherein the lowest temperature of the heating curve of the refrigerant flowing along said second path is maintained from 2° to 6 F. ° lower than the lowest temperature of the combined cooling curve of the feed material and the refrigerant flowing along said first and third paths, and the temperature differential therebetween is gradually and relatively uniformly permitted to diverge to a 20° to 40° F. differential at the hottest relative temperature thereof.

8. A process as set forth in claim 1, wherein said refrigerant composition is provided with an admixture of $C_1$ to $C_5$ hydrocarbons.

9. A process as set forth in claim 1, wherein said refrigerant compositon includes nitrogen and a series of $C_1$ to $C_5$ hydrocarbons.

10. A process as set forth in claim 1, wherein the material to be cooled is natural gas in gaseous condition at said initial temperature and the refrigerant composition is provided with an admixture on a mole fraction basis of 0% to 12% of nitrogen, 20% to 36% of $C_1$ hydrocarbon, 20% to 40% of a $C_2$ hydrocarbon, 2% to 12% of a $C_3$ hydrocarbon, 6% to 24% of a $C_4$ hydrocarbon and 2% to 20% of a $C_5$ hydrocarbon.

11. A process as set forth in claim 1, wherein said gaseous material is natural gas and wherein there is provided a refrigerant composition having a sufficiently wide boiling point range to effect cooling of the natural gas to a sufficiently low level to permit the latter to be expanded to essentially ambient pressure downstream of the heat exchange zone and remain in liquid condition at ambient pressure for delivery to a storage area.

* * * * *